US006207598B1

(12) United States Patent
Lee et al.

(10) Patent No.: US 6,207,598 B1
(45) Date of Patent: Mar. 27, 2001

(54) SOFT-FACED DRYER FABRIC

(75) Inventors: Henry J. Lee; Rex A. Treece, both of Summerville; Rachel H. Kramer, Walterboro, all of SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/354,039

(22) Filed: Jul. 15, 1999

Related U.S. Application Data

(60) Provisional application No. 60/093,028, filed on Jul. 16, 1998.

(51) Int. Cl.[7] ..... D03D 13/00

(52) U.S. Cl. ..... 442/206; 442/208; 442/205; 139/383 A

(58) Field of Search ..... 139/383 A; 442/203, 442/205, 206, 207, 208

(56) References Cited

U.S. PATENT DOCUMENTS

| | | | |
|---|---|---|---|
| 4,141,388 | 2/1979 | Romanski et al. | 139/383 A |
| 4,182,381 | 1/1980 | Gisbourne | 139/383 A |
| 4,334,556 | 6/1982 | Fröhlich et al. | 139/384 B |
| 4,813,156 | 3/1989 | Ashworth et al. | 34/116 |
| 4,941,514 | 7/1990 | Taipale | 139/383 A |
| 5,067,526 | 11/1991 | Herring | 139/383 A |
| 5,101,866 | 4/1992 | Quigley | 139/383 A |
| 5,164,249 | 11/1992 | Tyler et al. | 428/225 |
| 5,169,709 | 12/1992 | Fleischer | 428/225 |
| 5,358,014 | 10/1994 | Kovar | 139/383 A |
| 5,421,375 | 6/1995 | Praetzel | 139/383 A |
| 5,555,917 | 9/1996 | Quigley | 139/383 A |

FOREIGN PATENT DOCUMENTS

| | | |
|---|---|---|
| WO8704198 | 7/1987 | (WO) . |
| WO9117292 | 11/1991 | (WO) . |

*Primary Examiner*—Elizabeth M. Cole
(74) *Attorney, Agent, or Firm*—Volpe and Koenig, P.C.

(57) ABSTRACT

A multilayer papermaking fabric having interwoven machine direction (MD) and cross-machine direction (CMD) yarns, the CMD yarns defining at least upper and lower CMD yarn subsets which are interwoven with the MD yarns in a repeat pattern such that the MD yarns have substantially more interweavings with the upper CMD yarn subset than with the lower CMD yarn subset. The upper subset CMD yarns define sheetside floats over at least seven MD yarns and each MD yarn interweaves with only two upper subset CMD yarns in a given repeat.

19 Claims, 4 Drawing Sheets

100
110a
110b
110c
110d
110e
110f
110g
110h
110i
110j
110k
110l
110m
110n
110o
110p
120
122
124

SOFT-FACED DRYER FABRIC

This application claims the benefit of U.S. Provisional Application No. 60/093,028 filed Jul. 16, 1998, now abandoned.

BACKGROUND OF INVENTION

1. Field of the Invention

The present invention generally relates to a woven fabric designed for use in a papermaking machine. More particularly, the present invention relates to a woven fabric for use in the dryer section of a papermaking machine. Most particularly, the present invention relates to a fabric for use in dryer applications requiring a soft sheetside surface.

2. Description of the Prior Art

A conventional papermaking machine forms a web by depositing a slurry of pulp fibers to be formed into a paper sheet on a traveling forming wire. After initial dewatering on the forming wire, the paper sheet or web is transferred to a press section where the web passes through a number of press nips formed between roll couples. The press nips serve to consolidate the solid ingredients of the paper and at the same time to increase the dewatering of the slurry. Thereafter, the web is transferred to a dryer fabric which passes it over a series of heated dryer drums and possibly through a calendar.

Dryer fabrics are generally formed from materials resilient to high temperatures and hydrolytic degradation. However, these materials generally do not provide a smooth, paper contacting surface and therefore tend to mark the paper product. This is particularly a problem in fine grade paper applications, such as photographic paper. To reduce marking on the paper, many prior art fabrics generally employed a batt layer needled to the dryer fabric to achieve a soft, smooth sheetside surface. However, such a process is costly and time consuming.

Accordingly, there is a need for a fabric which includes temperature and degradation resistant materials and also provides a soft, smooth sheetside surface.

SUMMARY OF THE INVENTION

The present invention relates to a multilayer papermaking fabric having interwoven machine direction (MD) and cross-machine direction (CMD) yarns. The CMD yarns define at least upper and lower CMD yarn subsets. The subsets are interwoven with the MD yarns in a repeat pattern such that the MD yarns have substantially more interweavings with the lower CMD yarn subset than with the upper CMD yarn subset. The upper subset CMD yarns define sheetside floats over at least seven MD yarns and each MD yarn interweaves with only two upper subset CMD yarns in each repeat.

DESCRIPTION OF THE PREFERRED EMBODIMENTS

Figures 1, 2, 3, 4:
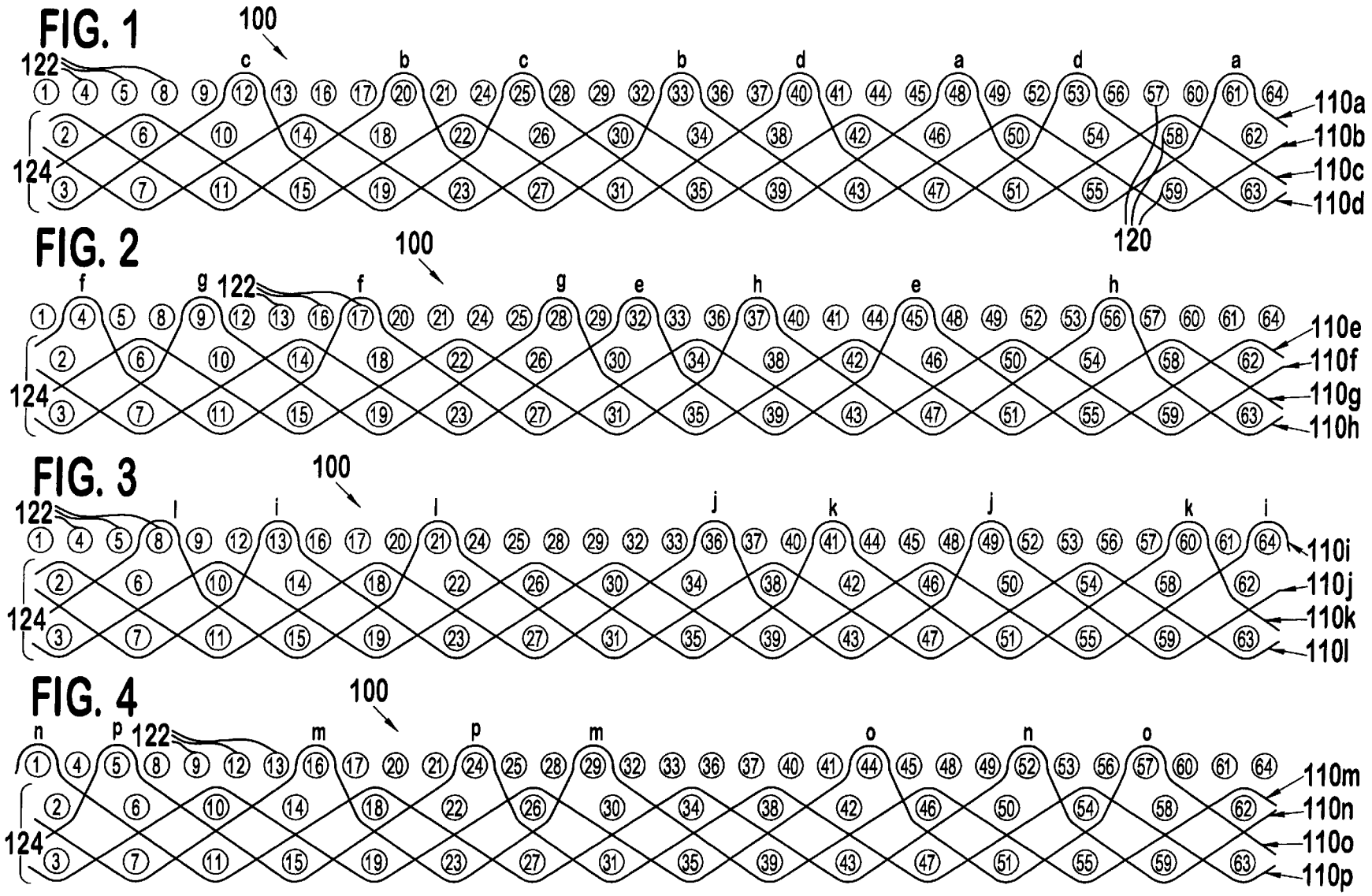
FIGS. 1–4 are weave structure diagrams of the preferred fabric of the present invention.
Figure 5:
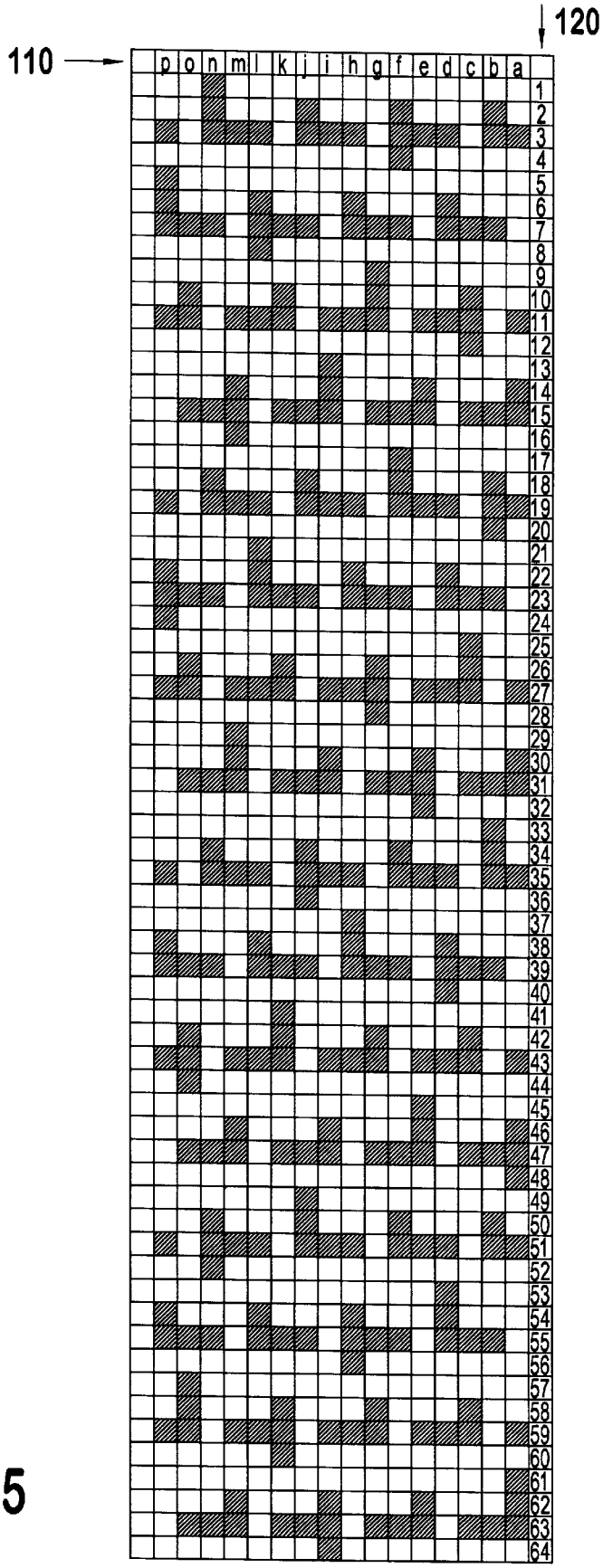
FIG. 5 is a weave pattern diagram of the preferred fabric wherein the darkened boxes represent where the MD yarns weave over a respective CMD yarn.

The preferred embodiment will be described with reference to the drawing figures where like numerals represent like elements throughout.

Referring to FIGS. 1–4, the preferred fabric 100 is shown. It generally comprises a system of MD yarns 110 interwoven with a system of CMD yarns 120. The CMD yarn system includes a lower machine contacting layer 124 and an upper layer 122. The lower layer 124 includes pairs of stacked CMD yarns 120. The upper layer 122 includes two adjacent CMD yarns 120 for every stacked pair of yarns in the lower layer 124.

The MD yarns 110 preferably weave in a pattern that repeats on sixty-four CMD yarns 120, but each MD yarn 110 weaves with only two CMD yarns of upper layer 122 in a given repeat. For example, MD yarn ll0*a* weaves in a standard "N" weave pattern with the lower layer 124 until it weaves over upper layer 122 CMD yarns 48 and 61. These "stitching points" at 48 and 61 join the CMD yarns of upper and lower layers 122 and 124 together. As shown in FIGS. 1–5, yarn 110*b* stitches over yarns 20 and 33; yarn 110*c* stitches over yarns 12 and 25; yarn 10*d* stitches over yarns 40 and 53; yarn 10*e* stitches over yarns 32 and 45; yarn 110*f* stitches over yarns 4 and 17; yarn 110*g* stitches over yarns 9 and 28; yarn 110*h* stitches over yarns 37 and 56; yarn 110*i* stitches over yarns 13 and 64; yarn 110*j* stitches over yarns 36 and 49; yarn 110*k* stitches over yarns 41 and 60; yarn 1101 stitches over yarns 8 and 21; yarn 110*m* stitches over yarns 16 and 29; yarn 11O*n* stitches over yarns 1 and 52; yarn 110*o* stitches over yarns 44 and 57; and yarn 120*p* stitches over yarns 5 and 24.

Figure 6:
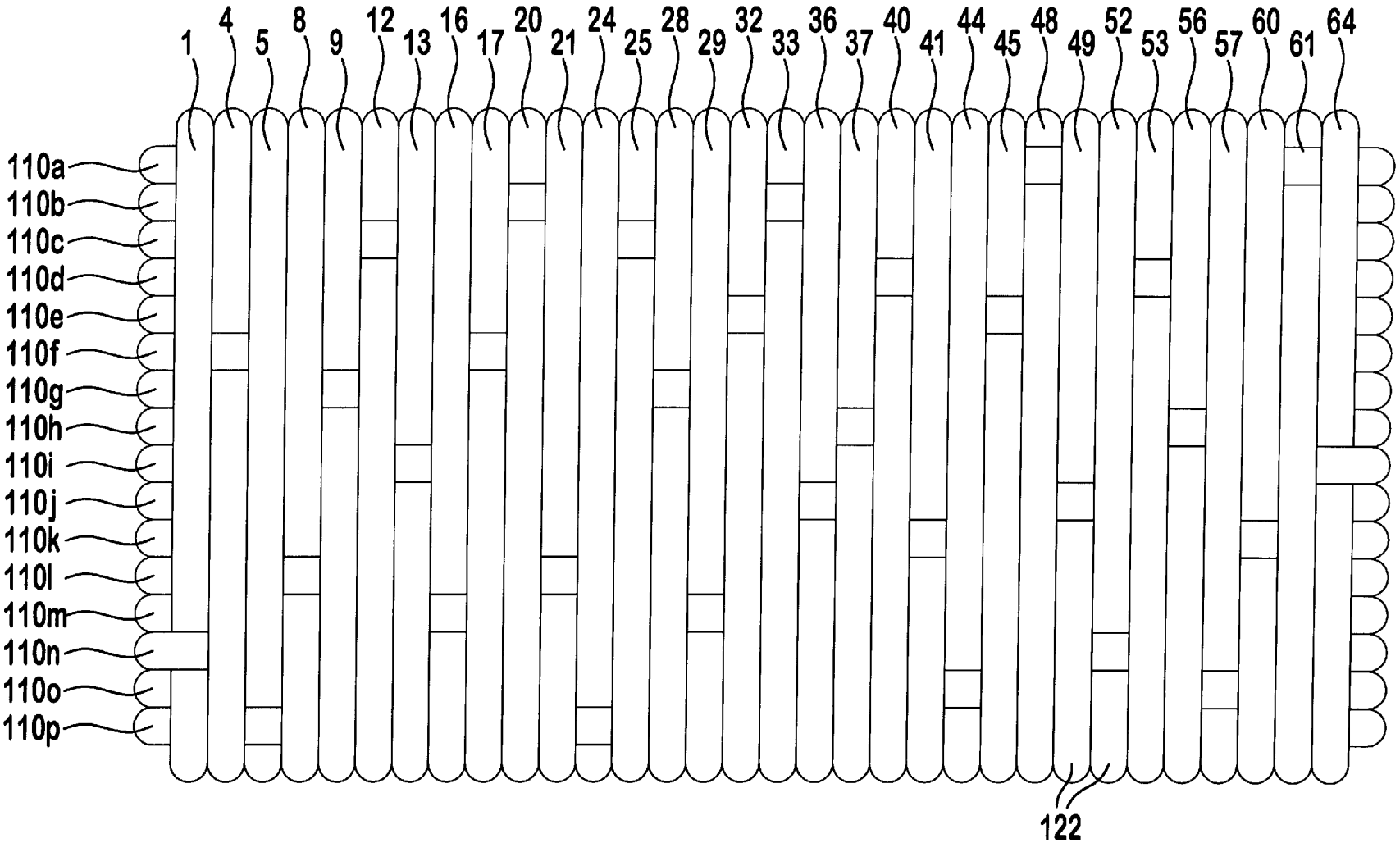
FIG. 6 is a top plan view of the preferred fabric.

As shown in FIG. 6, the reduced number of stitching points in the CMD yarns upper layer 122 produces floats that pass over fifteen of the MD yarns 110 in a given repeat. Each MD yarn 110 weaves with two upper layer 122 CMD yarns in a given repeat. These widely spaced interlacings allow the CMD yarns of upper layer 122 to be woven with minimum crimping. As such, the upper layer 122 CMD yarns extend above the plane of the MD yarns 110 sheetside knuckles. This produces a machine contacting surface which is dominated by the soft CMD yarns in upper layer 122. The CMD yarns of upper CMD layer 122 can be of various types of soft yarns including spun, taslinized, flocked, chenille and worsted yarns and may be chosen from many different materials, but are preferrably made from temperature resistant materials including polyester, acrylic, Ryton™, PCTA, and PEEK.

The CMD yarns of lower layer 124 and the MD yarns 110 can be of various materials. The MD yarns 110 are preferably made from a material having good tensile strength. Materials which also provide some temperature resistance, such as polyester or ryton, may be used. The fabric 100 can be endless woven or flat woven.

Figure 7:
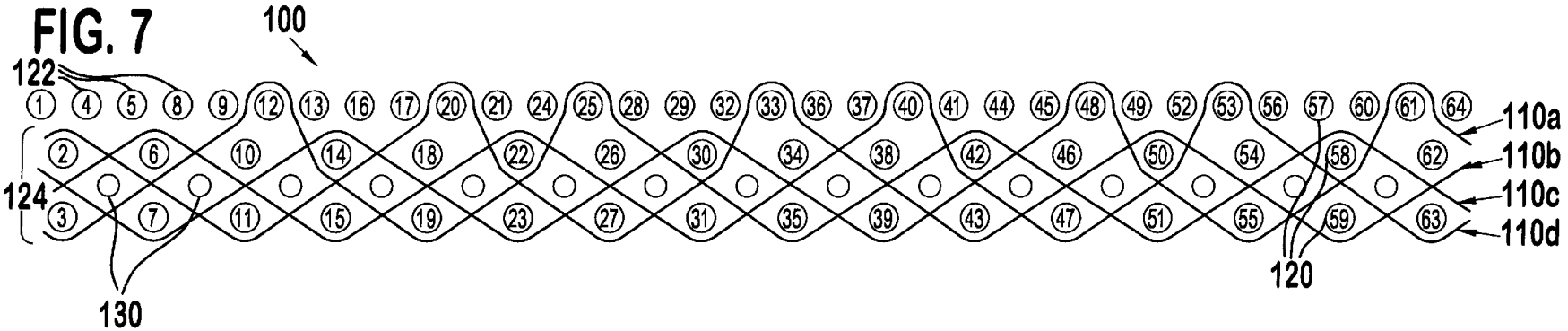
FIG. 7 is a weave structure diagram of an alternate embodiment of the present invention.

The permeability of the fabric may be adjusted by inserting stuffer yarns 130 in the fabric. As shown in FIG. 7, the stuffer yarns 130 are preferably inserted between each pair of CMD yarns of the lower layer 124.

Figure 8:
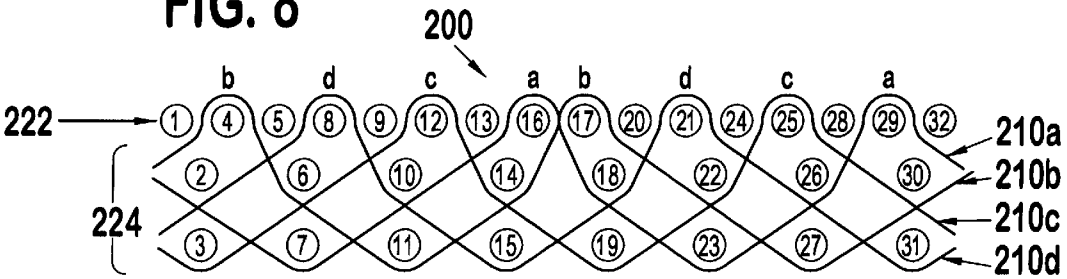
FIGS. 8–9 are weave structure diagrams of an alternate embodiment of the present invention.
Figure 9:
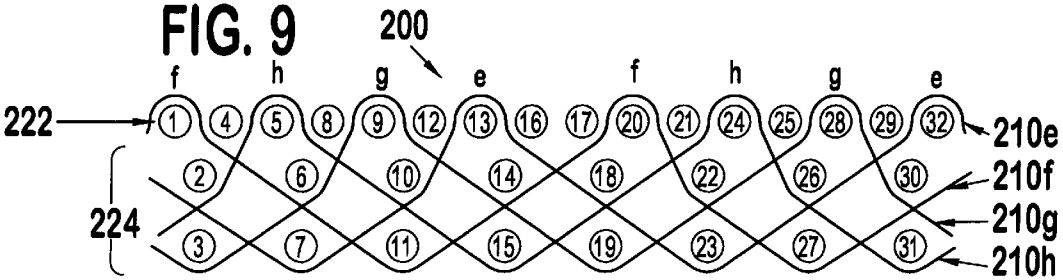

Referring to FIGS. 8–9, an alternate embodiment of the fabric 200 is shown. Similar to the preferred embodiment, fabric 200 also comprises a system of MD yarns 210 interwoven with a system of CMD yarns 220. The CMD yarn system 220 includes a lower machine contacting layer 224 and an upper layer 222. The lower layer 224 includes pairs of stacked CMD yarns 220 and the upper layer 222 includes two adjacent CMD yarns 220 for every stacked pair of yarns in the lower layer 224.

The MD yarns 210 of fabric 200 weave in a pattern that repeats on thirty-two CMD yarns 220 and weave with two upper layer CMD yarns 222 in a given repeat. For example, MD yarn 210*a* weaves between CMD yarns 2 and 3, under CMD yarn 7, between CMD yarns 10 and 11, over upper layer CMD yarn 16, between CMD yarns 18 and 19, under CMD yarn 23, between CMD yarns 26 and 27, and over upper layer CMD yarn 29 in a given repeat. Again, the upper layer CMD floats are in a plane above the MD yarn 210 sheetside knuckles.

What is claimed is:

1. A multilayer papermaking fabric having interwoven machine direction (MD) and cross-machine direction (CMD) yarns that is characterized by:

CMD yarns defining at least upper and lower CMD yarn subsets that are interwoven with the MD yarns in a repeat pattern such that the MD yarns have substantially more interweavings with the lower CMD yarn subset than with the upper CMD yarn subset and the upper subset CMD yarns define sheetside floats over at least seven MD yarns and each MD yarn interweaves with only two upper subset CMD yarns in each repeat.

2. The fabric of claim 1 wherein the upper CMD yarns weave in a pattern which includes a sheetside float of at least fifteen MD yarns.

3. The fabric of claim 2 wherein the MD yarns repeat on sixty-four CMD yarns.

4. The fabric of claim 2 wherein the lower CMD yarn subset includes pairs of stacked CMD yarns.

5. The fabric of claim 4 wherein the upper CMD yarn subset includes two adjacent CMD yarns for each stacked pair of lower subset CMD yarns.

6. The fabric of claim 5 wherein each MD yarn weaves under a lower CMD yarn stacked pair, between a lower CMD yarn stacked pair, over an upper CMD yarn, between a lower CMD yarn stacked pair, under a lower CMD yarn stacked pair, between a lower CMD yarn stacked pair, over an upper CMD yarn, between a lower CMD yarn stacked pair, under a lower CMD yarn stacked pair, between a lower CMD yarn stacked pair, over a lower CMD yarn stacked pair, between a lower CMD yarn stacked pair, under a lower CMD yarn stacked pair, between a lower CMD yarn stacked pair, over a lower CMD yarn stacked pair, and between a lower CMD yarn stacked pair in a given repeat.

7. The fabric of claim 1 wherein the upper subset CMD yarns are spun yarns.

8. The fabric of claim 1 wherein the upper subset CMD yarns are taslinized yarns.

9. The fabric of claim 1 wherein the upper subset CMD yarns are flocked yarns.

10. The fabric of claim 1 wherein the upper subset CMD yarns are chenille yarns.

11. The fabric of claim 1 wherein the upper subset CMD yarns are worsted yarns.

12. The fabric of claim 1 wherein the upper subset CMD yarns are manufactured from a material selected from the group consisting of polyester, acrylic, Ryton™, PCTA, and PEEK.

13. The fabric of claim 1 wherein the MD yarns are warp yarns and the CMD yarns are weft yarns.

14. The fabric of claim 1 wherein the MD yarns are weft yarns and the CMD yarns are warp yarns.

15. The fabric of claim 1 wherein the MD yarns repeat on thirty-two CMD yarns.

16. The fabric of claim 1 wherein the lower CMD yarn subset includes pairs of stacked CMD yarns.

17. The fabric of claim 16 wherein the upper CMD yarn subset includes two adjacent CMD yarns for each stacked pair of lower subset CMD yarns.

18. The fabric of claim 17 wherein each MD yarn weaves under a lower CMD yarn stacked pair, between a lower CMD yarn stacked pair, over an upper CMD yarn, between a lower CMD yarn stacked pair, under a lower CMD yarn stacked pair, between a lower CMD yarn stacked pair, over an upper CMD yarn, and between a lower CMD yarn stacked pair in a given repeat.

19. The fabric of claim 1 wherein stuffer yarns are positioned within the lower CMD yarn subset.

* * * * *

UNITED STATES PATENT AND TRADEMARK OFFICE

CERTIFICATE OF CORRECTION

PATENT NO. : 6,207,598 B1
DATED : March 27, 2001
INVENTOR(S) : Lee et al.

It is certified that error appears in the above-identified patent and that said Letters Patent is hereby corrected as shown below:

Column 2,
Line 18, replace "10d" with -- 110d --.
Line 19, replace "10e" with -- 110e --.

Signed and Sealed this

Sixth Day of November, 2001

*Attest:*

Nicholas P. Godici

NICHOLAS P. GODICI
*Acting Director of the United States Patent and Trademark Office*

*Attesting Officer*